US008328954B2

(12) United States Patent
Nagata et al.

(10) Patent No.: US 8,328,954 B2
(45) Date of Patent: Dec. 11, 2012

(54) METHOD OF MANUFACTURING PERMANENT MAGNET

(75) Inventors: Hiroshi Nagata, Ibaraki (JP); Yoshinori Shingaki, Ibaraki (JP)

(73) Assignee: Ulvac, Inc., Kanagawa (JP)

( * ) Notice: Subject to any disclaimer, the term of this patent is extended or adjusted under 35 U.S.C. 154(b) by 185 days.

(21) Appl. No.: 12/745,933

(22) PCT Filed: Dec. 25, 2008

(86) PCT No.: PCT/JP2008/073576

§ 371 (c)(1),
(2), (4) Date: Jul. 26, 2010

(87) PCT Pub. No.: WO2009/081978

PCT Pub. Date: Jul. 2, 2009

(65) Prior Publication Data

US 2010/0310408 A1 Dec. 9, 2010

(30) Foreign Application Priority Data

Dec. 25, 2007 (JP) ..... 2007-332143
Dec. 28, 2007 (JP) ..... 2007-339919

(51) Int. Cl.
*H01F 1/04* (2006.01)

(52) U.S. Cl. ..... 148/103; 148/101; 148/104; 148/302

(58) Field of Classification Search ..... None
See application file for complete search history.

(56) References Cited

U.S. PATENT DOCUMENTS

| | | | | |
|---|---|---|---|---|
| 5,137,587 | A * | 8/1992 | Schultz et al. | 148/103 |
| 5,449,481 | A * | 9/1995 | Sagawa et al. | 264/123 |
| 5,788,782 | A * | 8/1998 | Kaneko et al. | 148/103 |
| 6,599,468 | B2 * | 7/2003 | Okuyama et al. | 419/66 |
| 2009/0007417 | A1 * | 1/2009 | Yamashita et al. | 29/608 |
| 2010/0034688 | A1 * | 2/2010 | Nagata et al. | 419/32 |

FOREIGN PATENT DOCUMENTS

| | | | |
|---|---|---|---|
| JP | 01-124208 | A | 5/1989 |
| JP | 05-247601 | A | 9/1993 |
| JP | 06-325962 | A | 11/1994 |
| JP | 09-312229 | A | 12/1997 |
| WO | WO02/060677 | A1 | 8/2002 |

OTHER PUBLICATIONS

Office Action from Korean Patent App. No. 10-2010-7014012 (Aug. 16, 2011).
International Search Report for PCT Patent App. No. PCT/JP2008/073576 (Mar. 31, 2009).

* cited by examiner

*Primary Examiner* — John Sheehan
(74) *Attorney, Agent, or Firm* — Cermak Nakajima LLP; Tomoko Nakajima

(57) ABSTRACT

Crystal fractured surfaces of raw meal powder having more equal crystal orientation relationship in the magnetic field are arranged to be assembled together so that a method of manufacturing a permanent magnet which has an extremely high degree of orientation can be provided. In this invention, raw meal powder (P) is filled into a cavity, the raw meal powder (P) is oriented in the magnetic field while being pressed or urged by pressing means that has a smaller area than the cross-sectional area of the cavity. Semi-finished product thus oriented is compression-molded into a predetermined shape in the magnetic field.

13 Claims, 13 Drawing Sheets

Fig.12(a)

| Pressing step | Shape of pusher | Lateral movement of pusher | Total number of pressing of pusher | Front end shape of pusher | Material of pusher | Vertical vibration |
|---|---|---|---|---|---|---|
| Ⅰ | 25×50 | No | 1 | Square | Cast iron | No |
| Ⅱ | 25×50 | No | 1 | Square | SUS304 | No |
| Ⅲ | 25×50 | Yes | 2 | Square | SUS304 | No |
| Ⅳ | 35×50 | Yes | 4 | Square | Nylon | No |
| Ⅴ | 10×10 | Yes(vertical・lateral) | 25 | Square | Nylon | No |
| Ⅵ | 10×10 | Yes(vertical・lateral) | 50 | 45deg・pyramid | PEEK | No |
| Ⅶ | 10×10 | Yes(vertical・lateral) | 50 | 45deg・pyramid | PEEK | Yes |
| Ⅷ | No | No | 0 | – | – | – |

Fig.12(b)

| | Pressing step | Kind of powder | Addition of solid lubricant | Br(kG) | (BH)max (MG0e) | iHc(k0e) | Degree of orientation (%) |
|---|---|---|---|---|---|---|---|
| Example | Ⅰ | B | Yes | 14.5 | 51.5 | 14.2 | 95 |
| | Ⅱ | B | Yes | 14.7 | 53.0 | 14.1 | 96 |
| | Ⅲ | B | Yes | 14.8 | 53.7 | 14.0 | 97 |
| | Ⅳ | B | Yes | 15 | 55.1 | 14.1 | 98 |
| | Ⅴ | B | Yes | 15.1 | 55.9 | 14.2 | 99 |
| | Ⅵ | B | Yes | 15.1 | 55.8 | 14.1 | 99 |
| | Ⅵ | B | No | 14.8 | 53.7 | 14.1 | 97 |
| | Ⅶ | B | Yes | 15.2 | 56.6 | 14.2 | 99.5 |
| Comparative example | Ⅷ | B | Yes | 14.4 | 50.8 | 14.1 | 94 |
| | Ⅷ | B | No | 14.2 | 49.4 | 14.2 | 93 |
| Example | Ⅵ | A | Yes | 15 | 55.0 | 13.2 | 98 |
| Example | Ⅵ | C | Yes | 15.2 | 56.8 | 14.8 | 99.5 |

Fig.13

| | Kneading | Kind of powder | Addition of lubricant | Br(kG) | (BH)max (MG0e) | iHc(k0e) | Degree of orientation (%) |
|---|---|---|---|---|---|---|---|
| Example | Yes | B | No | 14.6 | 52.5 | 14.2 | 96 |
| | Yes | B | Yes | 15.0 | 55.0 | 14.2 | 98 |
| | Yes | A | Yes | 14.8 | 53.7 | 13.2 | 97 |
| | Yes | C | Yes | 15.2 | 56.8 | 14.8 | 99.5 |
| Comparative example | No | B | Yes | 14.4 | 50.8 | 14.1 | 94 |
| | No | B | No | 14.2 | 49.4 | 14.1 | 93 |

METHOD OF MANUFACTURING PERMANENT MAGNET

This application is a national phase entry under 35 U.S.C. §371 of PCT Patent Application No. PCT/JP2008/073576, filed on Dec. 25, 2008, which claims priority under 35 U.S.C. §119 to Japanese Patent Application Nos. 2007-332143, filed Dec. 25, 2007, and 2007-339919, filed Dec. 28, 2007, all of which are incorporated by reference.

TECHNICAL FIELD

The present invention relates to a method of manufacturing a permanent magnet and more particularly relates to a method to be used in manufacturing a Nd—Fe—B based magnet having a high degree of orientation.

BACKGROUND ART

A Nd—Fe—B based sintered magnet (so-called neodymium magnet) is made of a combination of iron and elements of Nd and B that are inexpensive and abundant natural resources and stably obtainable, and can thus be manufactured at a low cost and additionally has high magnetic properties (its maximum energy product is about 10 times that of ferritic magnet). Accordingly, the Nd—Fe—B based sintered magnets have been used in various kinds of articles such as electronic devices and have recently come to be adopted in motors and electric generators for hybrid cars. The amount of their uses is on the increase.

The Nd—Fe—B based magnets are mainly manufactured in a powder metallurgy method. In this method, Nd, Fe, and B are first formulated in a predetermined composition ratio, melted, and cast to thereby manufacture an alloy raw material. Then, the alloy raw material is once coarsely ground by, e.g., hydrogen grinding step and successively fine-ground by, e.g., jet mill fine grinding step, thereby obtaining raw metal (in powder form, hence referred to as raw metal powder). Then, the obtained raw metal powder is oriented in the magnetic field (magnetic field orientation), and is compression-molded in a state in which the magnetic field is being applied, thereby obtaining a molded (or formed) body. This molded body is sintered under predetermined conditions to thereby manufacture a sintered magnet.

In the compression molding method in the magnetic field, a uniaxial pressurizing type of compression molding machine is generally used. This compression molding machine is so arranged that raw metal powder is filled into a cavity (filling chamber) formed in a through hole or through hole in the die, and is pressed (or urged) by a pair of upper and lower punches in a vertical direction to thereby mold the raw metal powder. At the time of compression molding by the pair of punches, a high or superior orientation cannot be obtained due to friction among the particles in the raw metal powder filled into the cavity, or due to friction between the raw metal powder and the wall surfaces of the metallic mold set in position in the punch. There was thus a problem in that improvement in the magnetic properties cannot be attained.

As a solution to the above problem, there is known a compression molding method in which, after having filled the cavity with raw metal powder, at least one of the upper punch and the lower punch is subjected to vibrations in the direction of pressurizing (pressing direction) at the time of orientation in the magnetic field. In this compression molding method, by charging the magnetic field to the raw metal powder while vibrating the raw metal powder by the upper punch or the lower punch, the friction among the particles of the raw metal powder filled into the cavity can be changed from the static friction to the dynamic friction. The friction among the particles of the raw metal powder is thus reduced to thereby improve the flowability of the raw metal powder. As a result, the raw metal powder can be moved so as to be more aligned in the direction of orientation in the magnetic field, whereby the orientation can be improved (see patent document 1).

Patent document 1: International Patent Publication No. 2002/60677 (see, e.g., what is described in claims)

DISCLOSURE OF THE INVENTION

Problems to be Solved by the Invention

However, in the above-described compression molding method, only one of the upper punch and the lower punch is vibrated at the time of orientation in the magnetic field. Therefore, the positional relationship among the particles of the raw metal powder inside the cavity shows little or no change from the state in which it was initially filled into the cavity. In case the crystal fractured surfaces of the raw metal powder particles lying next to each other in the direction of orientation in the magnetic field are not aligned with one another (since the raw metal powder of the Nd—Fe—B based sintered magnet is manufactured by formulating Nd, Fe and B, melting, and alloying and then grinding, the surface of the raw metal powder has formed thereon crystal fractured surfaces that have no particular cleavage surfaces), there will remain clearance among the particles of the raw metal powder. The easy axis of magnetization of the raw metal powder thus does not align in the magnetic orientation direction. If the compression molding is carried out in this state, there is a problem in that the orientation will be in turbulence (not in order).

In view of the above-described points, the object of this invention is to provide a method of manufacturing a high-performance permanent magnet which is made of an oriented body, a molded body, and a sintered body having an extremely high or superior orientation by arranging such that the raw metal powder crystal fractured surfaces having more equal crystal orientation relationship can be combined together in the magnetic field or electric field.

Means for Solving the Problems

In order to solve the above problems, the method of manufacturing a permanent magnet includes the steps of orienting raw metal powder filled into a filling chamber, the orienting being carried out in a magnetic field by subjecting the raw metal powder to pressing by pressing means having a smaller area than a cross-sectional area of the filling chamber; and molding under compression an oriented semi-finished product obtained by the orienting step, into a predetermined shape in the magnetic field.

According to the invention, after having filled the filling chamber with the raw metal powder, the raw metal powder is oriented in the magnetic field. At this time, the pressing means is pressed or urged against the raw metal powder in the filling chamber in the same direction as the direction of filling the raw metal powder into the filling chamber. Here, the contact surface (the pressing surface) of the pressing means coming into contact with the raw metal powder is set to be smaller than the cross-sectional area of the filling chamber. Therefore, when the pressing means is kept on pressing against the raw metal powder, the raw metal powder is forced into the space between the pressing means and the inside of the filling chamber.

As a result, the bonding of the particles at the time of charging the magnetic field is once cut off and the positional relationship among the particles of the raw metal powder inside the filling chamber changes from the state in which the metal powder was initially filled into the filling chamber. And then, out of the combinations of the crystal fractured surfaces in the magnetic orientation direction, there will be more chances in which the crystal fractured surfaces having more equal crystal orientation relationship get combined. Once the crystal fractured surfaces having equal crystal orientation relationship get combined, firm bonding chains are formed. As a result, the crystal fractured surfaces get combined or joined without clearance in the magnetic orientation direction. By thus compression molding the semi-product in which the crystal fractured surfaces are combined without clearance in the magnetic orientation direction, there can be obtained a high-density permanent magnet which is free from turbulence or irregularity in the orientation.

In the invention the method preferably further includes changing the position of the pressing means sequentially so as to perform pressing by the pressing means over an entire cross-sectional area of the filling chamber. Then, the raw metal powder gets better mixed in the filling chamber. By thus changing the positional relationship among the particles inside the filling chamber, there will be more chances in which the crystal fractured surfaces having equal crystal orientation relationship get combined. This particularly holds true with the filling chamber which is rectangle in cross-section.

The method preferably further comprises vibrating the pressing means in the pressing direction at the time of pressing or urging the pressing means.

In this case, if the method further comprises adding to the raw metal powder a lubricant in a predetermined mixing ratio before filling the mixture into the filling chamber, the flowability of the raw metal powder is advantageously improved.

Further, in order to prevent the raw metal powder from getting adhered to the pressing means, the pressing means shall preferably be made of a non-magnetic material.

In order to solve the above-described problems, the method of manufacturing a permanent magnet includes the steps of: filling raw metal powder into a deformable bag body; orienting the raw metal powder inside the bag body in a magnetic field by applying a localized pressing force to the bag body, while kneading the raw metal powder inside the bag body; and compression molding the oriented raw metal powder in the magnetic field into a predetermined shape.

According to the invention, after having filled the raw metal powder into the bag body, the raw metal powder is oriented in the magnetic field. At this time, a pressing force is locally applied to the deformable bag body at a plurality of positions to thereby knead the raw metal powder inside the bag body. According to this operation, the bonding among the particles at the time of charging the magnetic field is once cut off. The positional relationship among the particles inside the bag body changes from the state in which the raw metal powder was initially filled into the filling chamber. Then, out of the combinations of the crystal fractured surfaces in the magnetic orientation direction, there will be more chances in which the crystal fractured surfaces having more equal crystal orientation relationship get combined. Once the crystal fractured surfaces having equal crystal orientation relationship are bonded to thereby form a strong bonding chain, the crystal fractured surfaces are aligned without clearance by getting bonded in the magnetic orientation direction. Then, by compression molding the semi-finished product in which the crystal fractured surfaces are bonded without clearance in the magnetic orientation direction, the semi-finished product will be of high density without turbulence or irregularity in orientation, thereby obtaining a high-performance magnet.

In this case, preferably the method further comprises mixing to the raw metal powder a lubricant in a predetermined mixing ratio before filling the mixture into the bag body. Then, the flowability of the raw metal powder is advantageously improved.

In the above invention, the method further comprises a step of sintering the oriented semi-finished product or compression-molded semi-finished product, in addition to the molding step or in place of the molding step.

In case the raw metal powder is for use with a rare-earth magnet and is manufactured by a quenching method, the crystal fractured surfaces can be made large in area with the raw metal powder being of angular particulate shape, and the clearance among the particles of the raw metal powder can be made small. In combination with the fact that there will be many chances of combining the crystal fractured surfaces of the raw metal powder having more equal crystal orientation relationship, the degree of orientation can be made extremely superior.

BEST MODE FOR CARRYING OUT THE INVENTION

With reference to the accompanying drawings, a description will be made of a compression molding (or forming) machine 1 which is suitable for manufacturing a rare-earth group permanent magnet of a first embodiment, in particular a Nd—Fe—B based sintered magnet. The compression molding machine 1 is of a uniaxial pressurizing type in which the pressurizing direction Y (pressing direction) is orthogonal to the magnetic orientation direction, and has a base plate 12 which is supported by leg pieces 11. Above the base plate 12 is disposed a die 2. The die 2 is supported by a plurality of supporting columns 13 which penetrate through the base plate 12. The other end of each of the supporting columns 13 is coupled to a coupling plate 14 which is provided below the base plate 12. The coupling plate 14 is connected to a driving means such as a cylinder rod 15 of a hydraulic cylinder of a known construction. According to this arrangement, by operating the lower hydraulic cylinder to thereby move the coupling plate 14 vertically, the die 2 becomes moveable in the pressurizing direction Y, i.e., in the vertical direction as can be seen in FIG. 1.

In substantially the central part of the die 2, there is formed a through hole 21 in the vertical direction. Into the through hole 21 there can be inserted, from a lower side, a lower punch 31 which is vertically disposed in substantially the central portion on the upper surface of the base plate 12 in a manner to extend upward. When the lower hydraulic cylinder is operated to lower the die 2, the lower punch 31 is inserted into the through hole 21, whereby a cavity (filling chamber) 22 is defined within the through hole 21. The cross-sectional shape of the through hole 21 (cavity 22) is appropriately selected from a circular shape, rectangular shape, and the like depending on the shape of the sintered magnet that is going to be molded from now on. In this embodiment, since a sintered magnet of rectangular parallelepiped is going to be manufactured, the cross-sectional shape is molded into a rectangular shape. With respect to the cavity 22 a powder feeding apparatus of a known construction (not illustrated) is movable toward, and away from, the cavity 22. It is so arranged that, by this powder feeding apparatus, an alloy powder material (also referred to as alloy raw metal powder) that has been weighed in advance can be filled into the cavity 22 (see FIG. 2).

Above the die 2 there is disposed a die base 16 in a manner to lie opposite to the base plate 12. On a lower surface of the die base 16 there is provided an upper punch 32 in a position which allows for insertion into the cavity 22. In addition, in the corner portions of the die base 16 there are formed through holes elongated in the vertical direction. Each of the through holes has penetrated therethrough a guide rod 17 one end of which is fixed to an upper surface of the die 2. To an upper surface of the die base 16 there is connected a driving means such as a cylinder rod 18 of a hydraulic cylinder (not illustrated) of a known construction. When this hydraulic cylinder is operated, the die base 16 becomes movable vertically guided by the guide rods 17 and, consequently, the upper punch 32 becomes movable in the vertical direction so as to be inserted into the through hole 21 of the die 2. According to this arrangement, at the time of compression molding, the raw metal powder P is subjected to compression inside the cavity 22 by means of the pair of the upper and the lower punches 31, 32, whereby the molded body can be obtained (molding step).

In addition, close to an outer periphery of the die 2 there is provided a magnetic field generating apparatus 4 so as to magnetically orient or align the raw metal powder P inside the cavity 22. The magnetic field generating apparatus 4 is disposed symmetrically so as to sandwich the die 2 from both sides and has a pair of yokes 41*a*, 41*b* which are made of a material high in magnetic permeability such as carbon steel, mild steel, pure iron, permendur, and the like. Both the yokes 41*a*, 41*b* have wound therearound coils 42*a*, 42*b*. By energizing each of the coils 42*a*, 42*b*, static magnetic field is generated in a direction X which is orthogonal to the pressurizing direction (vertical direction Y), whereby the raw metal powder P filled in the cavity 22 can be oriented.

Here, the raw metal powder P is manufactured in the following manner. In other words, by formulating Fe, B, Nd in a predetermined composition ratio, there is manufactured first an alloy of 0.05 mm~0.5 mm in quenching method, e.g., strip-casting method. On the other hand, there may be manufactured an alloy of about 5 mm thick in centrifugal casting method, and a small amount of Cu, Zr, Dy, Al, or Ga may be added at the time of formulation. Then, the manufactured alloy is subjected to coarse grinding by known hydrogen grinding step and is, subsequently, subjected to fine grinding by jet mill fine grinding step in nitrogen gas atmosphere, thereby obtaining a raw metal powder of average particle size diameter of 2~10 μm. In this case, if quenching method is employed, the raw metal powder P will be of angular particle shape. Therefore, the area of one crystal fractured surface can be made large, and the clearance among the raw metal powder P can be made small.

In order to improve the flowability of the raw metal powder P manufactured as above, there is added to the raw metal powder P a lubricant in a predetermined mixing ratio. The surface of the raw metal powder P is thus coated with the lubricant. As the lubricant, there is employed a solid lubricant or a liquid lubricant having low viscosity so as not to damage the die assembly.

As the solid lubricants, there can be listed lamellar compounds ($MoS_2$, $WS_2$, MoSe, graphite, BN, CFx, and the like), soft metal (Zn, Pb, and the like), rigid materials (diamond powder, TiN powder, and the like), organic polymers (PTEE based, aliphatic nylon based, higher aliphatic based, fatty acid amide based, fatty acid ester based, metallic soap based, and the like). It is particularly preferable to use zinc stearate, ethylene amide, and fluoroether based grease.

As the liquid lubricants, there can be listed natural grease material (vegetable oils such as castor oil, coconut oil, palm oil, and the like; mineral oils; petroleum based grease; and the like), and organic low molecular materials (low-grade aliphatic based, low-grade fatty amide based, low-grade fatty acid ester based, and the like). It is particularly preferable to use liquid fatty acid, liquid fatty acid ester, and liquid fluorine based lubricant. Liquid lubricants are used with surfactant or by dilution with solvent. The carbon residue content of the lubricant that remains after sintering lowers the coercive force of the magnet. Therefore, it is preferable to use low molecular weight materials to facilitate the removal thereof in the sintering step.

In case a solid lubricant is added to the raw metal powder P, addition may be made in a mixing ratio of 0.02 wt %~0.5 wt %. If the mixing ratio is less than 0.02 wt %, the flowability of the alloy raw metal powder P will not be improved and, consequently, the orientation will not be improved. On the other hand, if the mixing ratio exceeds 0.5 wt %, the coercive force lowers under the influence of the carbon residue content that remains in the sintered magnet when the sintered magnet is obtained. Further, in case a liquid lubricant is added to the raw metal powder P, it may be added in a range of 0.05 wt %~5 wt %. If the mixing ratio is less than 0.05 wt %, the flowability of the raw metal powder will not be improved and, consequently, there is a possibility that the orientation will not be improved. On the other hand, if the mixing ratio exceeds 5 wt %, the coercive force lowers under the influence of the carbon residue content that remains in the sintered magnet when the sintered magnet is obtained. By the way, as the lubricants, if both the solid lubricant and the liquid lubricant are added, the lubricants will be widely spread to every corner of the raw metal powder P and, due to higher lubricating effect, a higher orientation can be obtained.

Further, the compression molding machine 1 is provided with pressing means 5 which is movable toward, and away from, the cavity 22 so that, after having filled the cavity 22, i.e., the filling chamber, with the raw metal powder P containing therein the lubricants, and prior to the compression molding by a pair of the upper and lower punches 31, 32 (molding step), the raw metal powder P can be oriented (orientation step) in the magnetic field while kneading the raw metal powder P in the cavity 22, in a state in which the static magnetic field is generated (in the magnetic field) by energizing each of the coils 42*a*, 42*b* of the magnetic field generating apparatus 4.

As shown in FIG. 2, the pressing means 5 is made up of: a stationary frame 51; and a lifting frame 53 which is suspended by the stationary frame 51 through guide rods 52 so as to be movable up and down, and which is movable in the vertical direction. The stationary frame 51 has mounted thereon a cylinder 54, and a piston rod 54*a* which is elongated downward from the cylinder 54 is coupled to the lifting frame 53. It is thus so arranged that the lifting frame 53 is moved vertically by the cylinder 54. On the lower surface of the lifting frame 53 there is formed a guide rail 55 which is elongated in a direction orthogonal to the direction of movement of the piston rod 54*a*. The guide rail 55 is provided with a movable frame 56.

The movable frame 56 has connected thereto a pressing member 57 in a manner to extend in the vertical direction Y. The pressing member 57 is a solid pyramid member which is made of a non-magnetic material such as an engineering plastic like polyether ether ketone (PEEK), nylon and the like; and such as 18-8 stainless steel; and the like. According to this arrangement, the raw metal powder P can be prevented from getting insufficiently kneaded or the magnetic field can be prevented from getting disturbed due to adhesion of the raw metal powder P. The cross-sectional area of the pressing member 57 may be smaller than the cross-sectional area of the cavity 22 so that a predetermined clearance can be formed between the wall surfaces of the cavity 22 and the pressing member 57 when the raw metal powder P is pressed by the pressing member 57. However, taking the workability into consideration, it is preferable to set the cross-sectional area of the pressing member 57 to about ½~1/16 (½ in this embodiment) (see FIG. 3). Even in case the cross-sectional area of the pressing member 57 is set to ½ of the cross-sectional area of the cavity 22, it is necessary to determine the size so that the pressing member 57 does not contact the wall surfaces which define the cavity 22. In addition, shape of the pressing member 57 may be arbitrarily selected depending on the cross-sectional shape of the cavity 22. Further, the front end of the pressing member 57 shall preferably be of a plane or projected plane which is inclined toward the axial front side rather than a plane that is simply orthogonal to the axial direction of the pressing member 57.

The stationary frame 51 is mounted on two guide rails 58 which are elongated in a direction orthogonal to the pressurizing direction Y By causing the pressing means 5 to slide along the guide rails 58, the pressing means 5 becomes movable toward, and away from, the cavity 22. In this case, the power feeding apparatus may also be mounted on the same guide rails 58 so as to be movable toward, and away from, the cavity 22. Once the pressing means is stopped by a stopper (not illustrated) provided on the guide rails 58, the pressing member 57 is positioned so as to be able to apply a pressing force to about one half of the region of the cavity 22.

Although not illustrated, the above-described compression molding machine 1 may have the following arrangement. In other words, the guide rods 17 are provided with a shutter in a rotatable manner. When the raw metal powder P is kneaded by applying the pressing force thereto by the pressing member 57, the upper surface of the cavity 22 is closed by the shutter so that, while the raw metal powder is being kneaded, the raw metal powder P is prevented from getting splashed to the outside of the cavity 22.

Now, with reference to FIGS. 1 through 6, a description will be made of the manufacturing of the Nd—Fe—B based sintered magnet according to a first embodiment using the compression molding machine 1. First, from the stand-by position in which the upper surfaces of the die 2 and the lower punch 31 are respectively flush with each other, and in which the upper punch 32 is in the upper end (see FIG. 1), the hydraulic cylinder is operated to lift the die 2 to the predetermined position, thereby defining the cavity 22 inside the through hole 21. Then, by means of the powder feeding apparatus (not illustrated), the raw metal powder P that has been weighed in advance and that has added thereto a lubricant in a predetermined mixing ratio is filled into the cavity 22. The powder feeding apparatus is then retreated. In this case, the density of filling the raw metal powder P in the cavity 22 is set to be in the range of 10~30% of the volume of the cavity 22 in order to leave freedom of movement of the raw metal powder P (see FIG. 2).

Then, the pressing means 5 is positioned above the cavity 22 such that the pressing member occupies the left half of the cavity 22 (see FIGS. 2 and 3). When the cylinder 54 is operated to thereby lower the piston rod 54*a*, the lifting frame 53 is lowered, so that the pressing member 57 comes into surface contact with the raw metal powder P in substantially half the region of the cavity 22 (see FIG. 4(*a*)). At the same time, the coils 42*a*, 42*b* of the magnetic field generating apparatus 4 are charged with electricity, whereby a magnetic field is generated. In this case, in order to obtain a high or good orientation, it is preferable to carry out pressing (urging) with the pressing means 5 in the range of static magnetic field of 0.1 kOe~10 kOe, preferably of 0.5 kOe~6 kOe. If the intensity of the magnetic field is below 0.1 kOe, the semi-finished product of high orientation and high magnetic properties cannot be obtained. If the intensity of the magnetic field is greater than 10 kOe, the kneading becomes difficult.

Subsequently, when the lifting frame 53 is further lowered by the piston rod 54*a*, the pressing member 57 is forced into the raw metal powder P. In this case, the pressing force of the pressing member 57 shall preferably be set to 1~50 kg/cm$^2$. Or else, it may be so arranged that the pressing member 57 is vibrated in the pressing direction in a known method. Once the pressing member 57 is forced into the raw metal powder P, the raw metal powder P will be displaced into the clearance between the pressing member 57 and the inner wall surfaces of the cavity 22, because the area of contact surface of the pressing member 57 and the raw metal powder P is only half the cross-sectional area of the cavity 22 (see FIG. 4(*b*) and FIG. 4(*c*)). Then, after having moved the pressing member 57 just before the position in which the pressing member 57 comes into contact with the lower punch 31 (see FIG. 4(*c*)), the lifting frame 53 is once lifted to return the pressing member 57 to a predetermined position in height.

Then, the movable frame 56 is moved to align in position so that the pressing member 57 is positioned in the right half of the cavity 22 (see FIG. 4(*d*)). During this operation, the electric charging to the coils 42*a*, 42*b* of the magnetic field generating apparatus is not stopped. Then, the cylinder 54 is operated to thereby lower the piston rod 54*a* so that the pressing member 57 is forced into the raw metal powder P (see FIG. 4(*e*) and FIG. 4(*f*)). Series of these operations are repeated for a predetermined number of times (orienting step).

As in the conventional example as described above, despite the fact that the vibrations are applied by the upper punch or the lower punch, in case the crystal fractured surfaces of the raw metal powder P adjoining each other in the magnetic orientation direction as shown in FIG. 5(*a*) do not coincide with one another, clearance remains among the respective raw metal powder P. As a result, the raw metal powder P does not align in the magnetic orientation direction. If the compression molding is carried out in this state, the orientation will be in disorder. On the other hand, according to this embodiment, the bonding of the particles that have been once bonded when the magnetic field is charged will be once cut off, and the raw metal powder P will be oriented while getting kneaded in the magnetic field. As a result, the positional relationship among the particles of the raw metal powder P in the cavity 22 varies from the state in which it was initially filled into the cavity 22. There will thus be more chances for the crystal fractured surfaces of the raw metal powder P having more equal crystal orientation relationship to get combined. Once the crystal fractured surfaces of the raw metal powder P having more equal crystal orientation relationship get bonded, there will be formed a firm bonding chain. Accordingly, as shown in FIG. 5(*b*), the crystal fractured surfaces get bonded without clearance in the magnetic orientation direction just in a manner to form a bar shape, thereby aligning in the magnetic orientation direction.

Then, once the orientation step has been finished, the pressing means 5 is retrieved. In this case, the electric power supply to the coils 42*a*, 42*b* will not be stopped. The die base 16 will then be lowered so that the upper punch 32 is inserted into the penetration hole 21 from an upper side of the penetration hole 22 and, in a state in which the magnetic field is being charged, the compression molding of the raw metal powder P is started inside the cavity 22 by means of the pair of the upper and lower punches 31, 32. The electric supply to the coils 42*a*, 42*b* is stopped after a lapse of a predetermined time. In this state compression molding at the maximum pressure is carried out (see FIG. 6). Finally, by gradually raising the upper punch 32 to gradually reduce the pressure, the compression molding step is finished to thereby form a molded body M (molding step). According to this arrangement, compression molding is carried out in a state in which the raw metal powder P is bonded without clearance on the fractured surfaces in the magnetic orientation direction just in a manner to form a bar shape while being aligned in the magnetic orientation direction. Therefore, there can be obtained a high-density molded body M (permanent magnet) which is free from turbulence or disorder in orientation and is of high density. The magnetic properties thereof are also improved.

As described hereinabove, by carrying out the compression molding in a state in which the crystal fractured surfaces are bonded without clearance in the magnetic orientation direction, there can be obtained a high-density molded body M1 which is free from turbulence in orientation. As a result, the molded body increases in strength and can lower the rate of occurrence of defects, and a molded body M1 of high magnetic properties (permanent magnet) can be obtained. In this case, if a resin binder is mixed in the raw metal powder P to be filled into the cavity 22, there can be obtained a rare-earth group bonded magnet (molded body) of high magnetic properties.

The molding pressure in the molding step is set to a range of 0.1~2.0 t/cm$^2$, more preferably to 0.2~1.0 t/cm$^2$. At a molding pressure below 0.1 t/cm$^2$, the molded body does not possess a sufficient strength. For example, the molded body will be fractured when it is taken out of the cavity 22 of the compression molding machine. On the other hand, at a molding pressure exceeding 2.0 t/cm$^2$, a high molding pressure will be applied to the raw metal powder P inside the cavity 22, resulting in a possibility that the molding is carried out while the orientation is not in order, and also that the molded body gives rise to crazing or cracking. In addition, the strength of magnetic field in the molding step is set to a range of 5 kOe~30 kOe. If the magnetic field strength is smaller than 5 kOe, there cannot be obtained a molded body of high orientation and high magnetic properties. On the other hand, if the magnetic field strength is larger than 30 kOe, the magnetic field generating apparatus will be too big to be practical.

Then, after demagnetization by applying reverse magnetic field of, e.g., 3 kOe, the die 2 is lowered to the lowermost end. The molded body M in the cavity 22 will then be protruded from the upper surface and, after lifting the die base 16 so as to move the upper punch 32 to the elevated end, the molded body is taken out. Finally, the obtained molded body is contained in a sintering furnace (not illustrated) to sinter it e.g., in an Ar atmosphere, for a predetermined period of time at a predetermined temperature (1000° C.) (sintering step), and is further subjected to aging processing in an Ar atmosphere for a predetermined period of time at a predetermined temperature (500° C.) to thereby obtain a sintered magnet (Nd—Fe—B based sintered magnet).

Now, with reference to FIG. 7, a description will now be made of a compression molding machine 10 which is suitable for manufacturing a rare-earth permanent magnet, particularly Nd—Fe—B based sintered magnet, according to a second embodiment of this invention. The compression molding machine 10 is, like the one for carrying out the method of manufacturing the above-described first embodiment, of a uniaxial pressurizing type in which the direction of pressurizing Y (pressing direction) is orthogonal to the magnetic orientation direction, and has a base plate 120 which is supported by leg pieces 110. Above the base plate 120 is disposed a die 20. The die 20 is supported by a plurality of supporting columns 130 which penetrate through the base plate 120. The other end of each of the supporting columns 130 is coupled to a coupling plate 140 which is provided below the base plate 120. The coupling plate 140 is connected to a driving means such as a cylinder rod 150 of a hydraulic cylinder of a known construction. According to this arrangement, by operating vertically the lower hydraulic cylinder to thereby move the coupling plate 140 vertically, the die 20 becomes moveable in the pressurizing direction Y, i.e., in the vertical direction as seen in FIG. 7.

In substantially the central part of the die 20, there is formed a through hole 210 in the vertical direction. Into the through hole 210 there can be inserted, from a lower side, a lower punch 310 which is vertically disposed in substantially the central portion on the upper surface of the base plate 120 in a manner to extend upward. When the lower hydraulic cylinder is operated to lower the die 20, the lower punch 310 is inserted into the through hole 210, whereby a cavity (filling chamber) 220 is defined inside the through hole 210. The cross-sectional shape of the through hole 210 (cavity 220) is appropriately selected from a circular shape, rectangular shape, and the like depending on the shape of the sintered magnet that is going to be molded from now on. In the second embodiment, since a sintered magnet of rectangular parallelepiped is going to be manufactured, the cross-sectional shape is also molded into a rectangular shape.

Above the die 20 there is disposed a die base 160 in a manner to lie opposite to the base plate 120. On a lower surface of the die base 160 there is provided an upper punch 320 in a position which allows for insertion thereof into the cavity 220. In addition, in the corner portions of the die base 160 there are formed through holes in the vertical direction. Each of the through holes has penetrated therethrough a guide rod 170 one end of which is fixed to an upper surface of the die 20. To an upper surface of the die base 160 there is connected a driving means such as a cylinder rod 180 of a hydraulic cylinder (not illustrated) of a known construction. When this hydraulic cylinder is operated, the die base 160 becomes movable vertically guided by the guide rods 170 and, consequently, the upper punch 320 becomes movable in the vertical direction so as to be inserted into the through hole 210 of the die 20. According to this arrangement, at the time of compression molding, the raw metal powder P is subjected to compression inside the cavity 220 by means of the pair of the upper and the lower punches 310, 320, whereby the molded body can be obtained.

In addition, in an outer periphery of the die 20 there is provided a magnetic field generating apparatus 4 for charging the magnetic field at the time of orienting the raw metal powder P while it is kneaded inside a bag body (to be described hereinafter), and also at the time of molding the raw metal powder P inside the cavity 220. Since the magnetic field generating apparatus 4 is used in connection with the above-described compression molding machine 1, a detailed description thereof is omitted here. In addition, since the raw metal powder P that is similar to the one referred to in the above-described first embodiment can be used, a detailed description thereof is also omitted here.

The compression molding machine 10 is provided with a kneading means 50 for kneading the raw metal powder P filled into the bag body B by kneading it in the magnetic field, the kneading means 50 being provided in a manner to be movable back and forth in a space above the cavity 220. The kneading means 50 has a supporting frame 510. The supporting frame 510 has mounted thereon a plurality of cylinders 520. Each of piston rods 520*a* which extend downward from each of the cylinders 520 has attached thereto a pusher (pushing means) 530 which is of a cylindrical member made of a non-magnetic material. The kneading means 50 has also a frame body 550 which is suspended by piston rods 540*a* extending downward from other cylinders 540 mounted on the supporting frame 510.

The frame body 550 is of a square columnar shape with the upper surface left open. The inner side surfaces thereof are formed such that a plurality of continuous projections and depressions are repeated. On the other hand, in the inner central portion of the bottom plate of the frame body 550, there is formed a projected portion or bump 550*a*. The frame body 550 contains therein a bag body B into which is filled the above-described raw metal powder P that has been weighed in advance. The bag body B is made of a deformable material such as rubber, elastomer, polyethylene, vinyl, and the like. After having contained the bag body B inside frame body 550, each of the cylinders 520 is operated simultaneously or with time difference. Then, a local pressing force is applied to the bag body B by each of the pushers 530. At this time, the bag body B is expanded at the lower center around the bump 550*a* and the side portions are deformed so as to intrude into the recessed portions on the side surfaces. As a result, the raw metal powder P inside the bag body B comes to be kneaded.

With reference to FIGS. 7 through 11, a description will now be made of manufacturing of Nd—Fe—B based sintered magnet according to a second embodiment using the above-described compression molding machine 10. First, in a standby position in which the upper surfaces of the die 20 and the lower punch 310 are flush with each other and in which the upper punch 320 is positioned in the upper end (see FIG. 7), the kneading means 50 is moved to the portion above the cavity 220. At this time, the bag body B has already been filled with the raw metal powder P that was weighed in advance, and the bag body B is contained in the frame body 550. The filling density inside the bag body B of the raw metal powder P is set to a range of 15~55% of the volume of the bag body B in order to leave a degree of freedom of movement of the raw metal powder P. The volume of the bag body B having filled therein with the raw metal powder P is set to a range of 30~80% relative to the volume of the frame body 550.

Then, the coils 42*a*, 42*b* of the magnetic field generating apparatus 4 are charged with electricity to thereby apply the magnetic field. In this case, in order to obtain high orientation, it is preferable to carry out kneading by the kneading apparatus 5 (kneading means 50) in a magnetic field in a range of 0.1 kOe~10 kOe, preferably of 0.5 kOe~6 kOe. If the magnetic field is less than 0.1 kOe, it is not possible to obtain a sintered magnet having high orientation and high magnetic properties. If the intensity of the magnetic field is greater than 10 kOe, the kneading becomes difficult. Then, in a state in which the magnetic field is being applied, each of the cylinders 520 is operated simultaneously or with a time difference, thereby locally applying a pressing force by each of the pushers 530 to the bag body B (orienting step: see FIG. 9).

As described above, in the conventional example, even if vibrations were to be applied by the upper punch or the lower punch, there will remain a clearance among the raw metal powder P in case the crystal fractured surfaces of the particles of the raw metal powder P adjoining one another in the magnetic orientation direction do not match one another as shown in FIG. 10(*a*). As a result, the raw metal powder P will not align in the direction of magnetic orientation. If a compression molding is carried out in this state, the orientation gets irregular or will be disturbed. On the other hand, according to the second embodiment, the lower center of the bag body B will be expanded toward the circumference of the projected portion 550*a* and also the side portions of the bag body B will be deformed so as to intrude into the recessed portions of the side walls, whereby the raw metal powder P inside the bag body B will be kneaded. In this case, the bonding among the particles once bonded when the magnetic field was charged will be once cut off, and the raw metal powder P comes to be oriented while being mixed in the magnetic field. As a result, the positional relationship among the particles of the raw metal powder P inside the cavity 220 will vary from the state in which it was initially filled into the cavity 220. There are thus more chances for the crystal fractured surfaces of the raw metal powder P having more equal crystal orientation relationship, to get combined together. Once the crystal fractured surfaces of the raw metal powder P having more equal crystal orientation relationship get bonded together, there will be formed strong or firm bonding chains. Accordingly, as shown in FIG. 10(*b*), the crystal fractured surfaces are bonded without clearance among them in the magnetic orientation direction just in a manner to form a bar shape, thereby aligning in the magnetic orientation direction.

Then, by operating the hydraulic cylinder, the die 20 is lifted to a predetermined position to thereby define the cavity 220 inside the through hole 210. Then, the oriented raw material alloy is taken out of the bag body B and is filled into the cavity. In this case, the charging of the raw material alloy into the cavity 220 can be carried out manually. On the other hand, the following arrangement can also be employed, namely: the bottom surface of the frame body 550 is formed so as to be openable and closable; a cutting tool (not illustrated) is disposed so as to be moveable toward and away from the bag body B; and the bag body B is partly cut by the cutting tool in a state in which the magnetic field is being charged, whereby the raw material alloy inside the bag body B can be automatically dumped into the cavity 220.

Then, once the orienting step has been finished, the kneading means 50 is retreated. In this case, the electric charging to the coils 42*a*, 42*b* is not stopped. Then, the upper punch 320 is inserted into the through hole 210 from above the through hole 220 by lowering the die base 160. In a state in which the magnetic field is being charged, the compression molding of the raw metal powder P is started inside the cavity by means of a pair of the upper and lower punches 310, 320. After a lapse of a predetermined time, the electric charging to the coils 42*a*, 42*b* is stopped and in this state compression molding at a maximum pressure is carried out (see FIG. 11). Finally, the upper punch 320 is gradually lifted to thereby gradually depressurize, whereby the compression molding is finished and the molded body M1 is molded (molding step). Also in this case, the compression molding of the raw metal powder P is carried out in a magnetically aligned state in which the crystal fractured surfaces of the raw metal powder P are closely bonded together without clearance among respective crystal fractured surfaces in the magnetic orientation direction in a manner to form a so-called bar shape. Therefore, there can be obtained a high-density molded body M1 (permanent magnet) without turbulence in orientation, and the magnetic properties can also be improved.

In this manner, by carrying out the compression molding in a state in which the crystal fractured surfaces are bonded together in the magnetic orientation direction without clearance among respective surfaces, a high-density molded body M1 can be obtained without turbulence in orientation. The strength of the molded body thus increases with the result that the rate of occurrence in inferior quality can be reduced, and a molded body M1 of high magnetic properties can be obtained. In this case, if a resin binder is mixed into the raw metal powder P to be filled into the cavity 220, there can be obtained a rare earth group bond magnet (molded body) of high magnetic properties.

The molding pressure in the molding step is set to a range of 0.1~2.0 t/cm$^2$, preferably to 0.2~1.0 t/cm$^2$. At a molding pressure below 0.1 t/cm$^2$, the molded body will not have sufficient strength. For example, cracks will occur to the molded body when it is pulled out of the cavity 220 of the compression molding apparatus. On the other hand, at a molding pressure above 2.0 t/cm$^2$, a high molding pressure is applied to the raw metal powder P in the cavity 220. As a result, the molding will be carried out while the orientation is struck out of order, and also there is a possibility that cracks and fractures occur to the molded body. The intensity of the magnetic field in the molding step is set to a range of 5 kOe~30 kOe. If the intensity of the magnetic field is below 5 kOe, a highly oriented molded body having high or superior magnetic properties cannot be obtained. On the other hand, if the intensity of the magnetic field is greater than 30 kOe, the magnetic generation apparatus will become too big to be practical.

Then, after demagnetization by charging reverse magnetic field of, e.g., 3 kOe, the die 20 is lowered to the lower end. The molded body M1 in the cavity 220 will thus be pulled out to the upper surface of the die 20. After moving the upper punch 320 to the upper end by lifting the die base 160, the molded body is taken out. Finally, the molded body thus obtained is contained into a sintering furnace (not illustrated), is sintered for a predetermined period of time at a predetermined temperature (1000° C.) in, e.g., an Ar atmosphere (sintering step), and is further subjected to aging treatment at a predetermined temperature (500° C.) for a predetermined period of time in an Ar atmosphere, thereby obtaining a sintered magnet (Nd—Fe—B based sintered magnet).

In the above-described first and second embodiments, descriptions have so far been made of a uniaxial pressurizing type of compression in which the direction of molding is orthogonal to the direction of the magnetic field. Without being limited thereto, there may be employed a compression molding machine in which the direction of molding is in parallel with the direction of the magnetic field. In the first embodiment, a description has been made of molding a powder body by using a uniaxial pressurizing type of compression machine 1. Alternatively, there may be employed an isostatic pressing molding machine (not illustrated) of a known structure using a rubber mold.

In addition, in the above-described first and second embodiments, descriptions have been made of examples in which, as the orienting magnetic field at the time of pressurizing or kneading and molding, there was used a static magnetic field in which the intensity of magnetic field per unit time does not change. Without being limited thereto, there may be used pulsating magnetic field in which the intensity of the magnetic field varies at a certain period. In this case, an arrangement may also be made that a reverse magnetic field is charged. According to this arrangement, since vibrations can be applied to the raw metal powder P at the time of molding, the degree of orientation can be further improved. Preferably, the pulse period shall be set to 1 ms~2 s, and no-output time shall be set to 500 ms or less. In the range outside the above-described range, the strong bonding chains will be broken, with the result that high orientation cannot be obtained. In addition, in case the pulsating magnetic field is charged, the peak value thereof shall preferably be set to a range of 5~50 kOe. If the intensity of the magnetic field is blow 5 kOe, there cannot be obtained a product of high orientation and high magnetic properties. On the other hand, if the intensity of the magnetic field is greater than 50 kOe, the magnetic field generating apparatus will be too large and the durability of the apparatus will become too low to be practical.

Further, in the above-described first and second embodiments, descriptions have so far been made of examples of manufacturing sintered magnets. It is to be noted that the method of manufacturing a permanent magnet of this invention can be applied to the following: i.e., the art of manufacturing an oriented body by orienting a powder that polarizes in the magnetic field or electric field; the art of compression-molding, in the magnetic field or electric field, the semi-finished product thus oriented; and the art of sintering, in addition to or in place of compression molding, the semi-finished product thus oriented in the magnetic field or electric field. For example, this art can be applied to the manufacturing of a (Tb, Dy) Fee based super-magnetostrictive material, $SrO.6Fe_2O_3$ based material, $(Sr, La)O.6(Fe, Co)_2O_3$ based ferritic sintered magnet, $SmFe_{17}$ based nitride bond magnet, Nd—Fe—B based HDDR bond magnet, and the like. In addition, this art can be applied to the manufacturing of a silicon nitride ($Si_3N_4$) sintered body which is manufactured by molding a predetermined powder in the magnetic field and then sintering it.

Example 1

In Example 1, Nd—Fe—B based raw metal powder was manufactured as described below; orienting step and molding step were carried out by using the below-mentioned molding apparatus, thereby manufacturing a predetermined molded body; then, sintering step was carried out in which this molded body was sintered in an Ar atmosphere at a temperature of 1050° C. for three hours. As a result, there was obtained a Nd—Fe—B based sintered magnet.

(Raw Metal Powder)

As the Nd—Fe—B based sintered magnet, an alloy was manufactured by a strip casting method by using one whose composition was 22Nd-7Pr-0.95B-1Co-0.2Al-0.05Cu-0.1Zr-0.05Ga-bal.Fe. The alloy was then subjected to hydrogen grinding in hydrogen gas of 0.2 atmosphere for three hours (hydrogen grinding step). Then, vacuum dehydrogenation processing was carried out at 500° C. for three hours.

Successively, fine grinding was carried out in a jet mill fine grinding step to manufacture raw metal powder P having a half value width of the powder particle size distribution of 10 μm (raw metal powder A), 4 μm (raw metal powder B), and 2 μm (raw metal powder C), respectively, with an average particle diameter of 3 μm.

(Orienting Step)

In the orienting step, there was used a uniaxial pressurizing type of compression molding machine 1, as shown in FIG. 1. Here, the compression molding machine 1 is so arranged that a static magnetic field of 20 kOe can be charged to the cavity 22 having an opening of 50×50 mm square. First, the cavity 22 was filled with the above-described raw metal powder A, B, C. Prior to filling, particular alloy raw material was added thereto 0.3% of solid lubricant (zinc stearate). Further, an arrangement was made such that the filling was made to the depth of 75 mm at a packing density of 25%. Then, while charging the magnetic field of 4 kOe, the pressing force was set to 10 kg/cm$^2$ and the raw metal powder A, B, C was urged or pressed by the pressing means 5 to thereby subject the raw metal powder A, B, C for orientation. The conditions such as the shape of the pressing means 5 at this time and the number of pressing, and the like are given in FIG. 12(*a*).

(Molding Step)

In the molding step, by using the uniaxial type of compression molding machine 1 as shown in FIG. 1, the above-described oriented semi-finished product was subjected to compression molding by means of a pair of the upper and lower punches 31, 32 (molding step) while charging the magnetic field of 20 kOe to the semi-product. The molding pressure at this time was set to 0.5 t/cm$^2$. Then, after compression molding, a reverse magnetic field of 2 kOe was charged and, after demagnetization, the molded body was taken out of the cavity 22.

(Sintering Step)

By using a sintering furnace having a known construction, the above-described molded body was subjected to sintering process. In this case, the sintering was carried out at a sintering temperature of 1050° C. for three hours. Prior to sintering, hydrogen at a temperature between 100° C. and 500° C. was caused to flow through vacuum of 100 Pa to carry out the processing to remove binder. After the processing to remove binder, the flow of hydrogen was stopped immediately, and dehydrogenation processing was carried out to vacuum degree of down to $10^{-5}$ Pa. After sintering, the sintered magnet was subjected to heat treatment at 500° C. for two hours and was thereafter cooled to room temperature.

FIG. 12(*b*) is a table showing the magnetic properties and degree of orientation when the sintered magnet was obtained by changing the kind of raw metal powder, the method of pressing by the pressing means, and the like. The magnetic properties are average values when evaluated by the BH tracer, and the degree of orientation is shown in values obtained by dividing the values of remanent flux density by saturated magnetic flux density at 10 T.

According to the above arrangement, it can be seen that the narrower (sharper) becomes the half value width of the particle size diameter of the raw metal powder, the better become the degree of orientation and the coercive force. Further, it can be seen that the more becomes the number of pressing of the pressing means, the better becomes the degree of orientation. Still furthermore, the pressing means is made of a non-magnetic material and it can thus be seen that the degree of orientation improves by adding a lubricant to the raw metal powder. On the other hand, the front end of the pressing means is sharp or pointed and it can be seen that the degree of orientation is improved by applying the vertical vibrations.

Example 2

In Example 2, Nd—Fe—B based raw metal powder was manufactured as described below: orienting step and molding step were carried out by using the below-mentioned molding apparatus, thereby manufacturing a predetermined molded body; and then sintering step was carried out in which this molded body was sintered in an Ar atmosphere at a temperature of 1050° C. for three hours. As a result, there was obtained a Nd—Fe—B based sintered magnet.

(Raw Metal Powder)

As the Nd—Fe—B based sintered magnet, there was used one whose composition was 23Nd-7Pr-0.98B-1Co-0.2Al-0.1V-0.05Sn-bal.Fe. An alloy was manufactured by strip casting method and the alloy was then subjected to hydrogen grinding in a hydrogen gas of 0.2 atmosphere for three hours (hydrogen grinding step). Then, vacuum dehydrogenation processing was carried out at 500° C. for three hours.

Successively, the semi-finished product was subjected to fine grinding by jet mill fine grinding step. There were thus manufactured raw metal powder P having a half value width of the powder particle size distribution of 10 μm (raw metal powder A), 6 μm (raw metal powder B), and 2 μm (raw metal powder C), respectively, with an average particle size diameter of 5 μm. At this time, a solid lubricant (zinc stearate) was added by 0.3% and methyl caproate was added by 0.5% as required.

(Orienting Step)

In an orienting step, there was used the uniaxial pressurizing type of compression molding machine 1 as shown in FIG. 7. In this case, each raw metal powder of 800 g was contained in a bag body B of urethane rubber make having a thickness of 0.02 mm and a volume of 500 cc. After housing the bag body B inside the frame body 550, each of three pushers 530 capable of applying a pressing force of 5 kg was operated alternately for 5 seconds at a cycle of 0.5 seconds. Also the coils 42*a*, 42*b* of the magnetic field generating apparatus 4 were charged with electricity to thereby charge the static magnetic field of 1 kOe. Alloy raw material inside the bag body was kneaded and oriented in the magnetic field (orienting step).

(Molding Step)

In the molding step, there was used the uniaxial pressurizing type of compression molding machine 10 as shown in FIG. 6. While charging the static magnetic field of 25 kOe to the oriented alloy raw material, compression molding was carried out by the pair of the upper and lower punches 310, 320 (molding step). In this case, the cavity 220 had an opening of 75×75 mm square, and the molding pressure was set to be 0.4 t/cm$^2$. Then, after compression molding, demagnetization was carried out by charging the reverse magnetic field of 3 kOe. The molded body was then taken out of the cavity 220.

(Sintering Step)

By using a sintering furnace having a known construction, the above-described molded body was subjected to sintering process. In this case, the sintering was carried out at a sintering temperature of 1050° C. for three hours. Prior to sintering, hydrogen at a temperature between 100° C. and 500° C. was caused to flow through vacuum of 1 Pa to carry out the processing to remove binder. After the processing to remove binder, the flow of hydrogen was stopped immediately, and dehydrogenation processing was carried out to vacuum degree of down to $10^{-3}$ Pa. After sintering, the sintered magnet was subjected to heat treatment at 500° C. for two hours, and was then cooled to room temperature.

FIG. 13 is a table showing the magnetic properties and degree of orientation when the sintered magnet was obtained by changing the kind of raw metal powder. The table also shows the magnetic properties and the degree of orientation when the sintered magnet was obtained without kneading 800 g of raw metal powder but by directly filling the raw metal powder into the cavity (Comparative Examples), thereby obtaining the sintered magnet under the same conditions as the above-described Examples. The magnetic properties are average values as a result of evaluation by the BH tracer, and the degree of orientation is shown in values obtained by dividing the value of remanent flux density by saturated magnetic flux density at 10 T.

According to the above arrangement, it can be seen that the narrower (sharper) becomes the half value width of the particle size diameter of the raw metal powder, the better become the degree of orientation and the coercive force. Further, it can also be seen that, if the raw metal powder is kneaded at the time of orienting step, the degree of orientation is improved and, particularly, the maximum energy product becomes higher. It can also be seen that the degree of orientation is improved by adding a lubricant.

BRIEF DESCRIPTION OF THE DRAWINGS

FIG. 12(*a*) is a table showing the conditions such as the shape of the pressing means, the number of pressing operation, and the like, and FIG. 12(*b*) is a table showing the magnetic properties and the degree of orientation of a sintered magnet manufactured according to example 1 of this invention; and FIG. 13 is a table showing magnetic properties and the degree of orientation of a sintered magnet manufactured according to example 2 of this invention.

DESCRIPTION OF REFERENCE NUMERALS AND CHARACTERS

Figure 1:
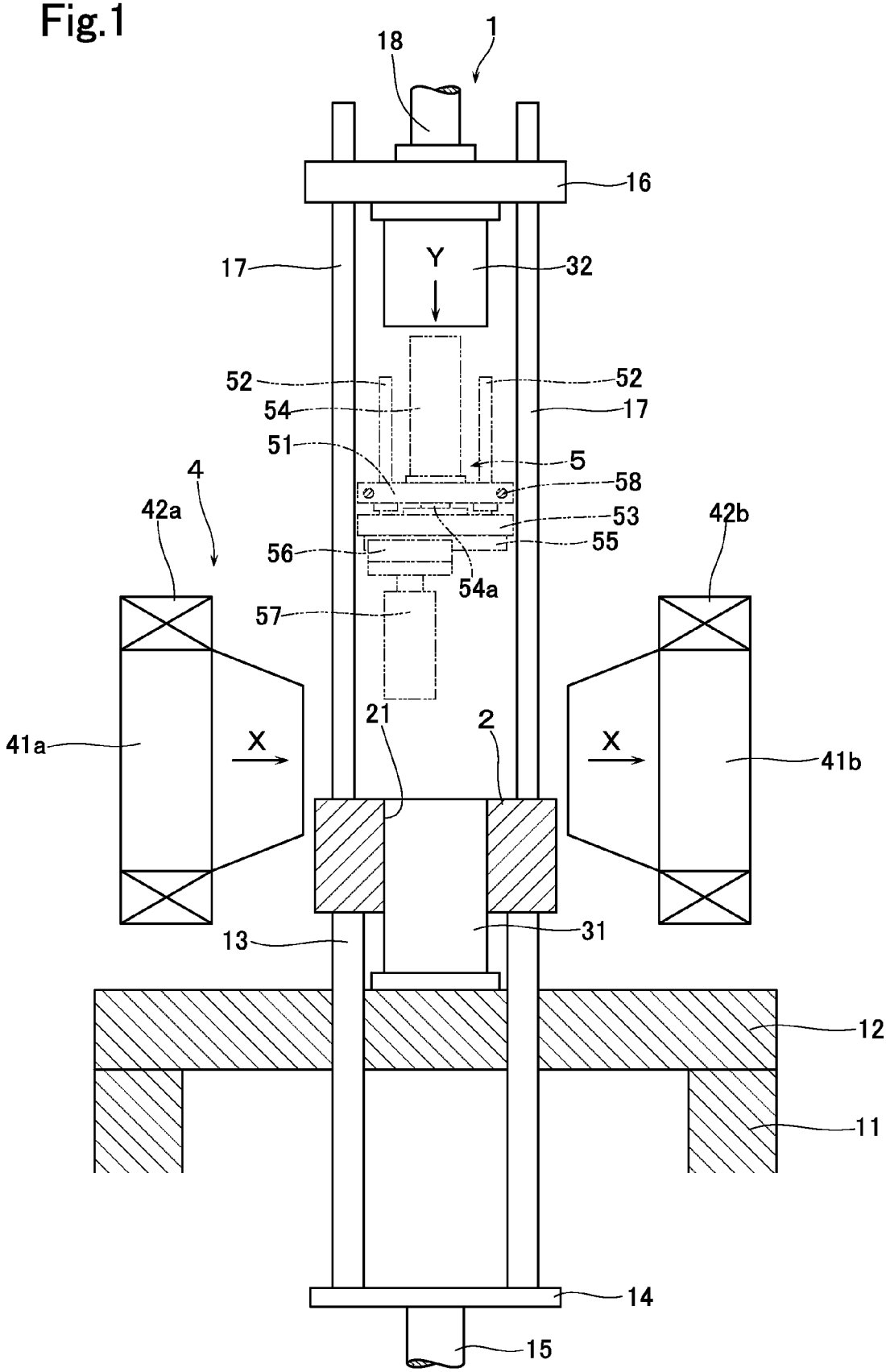
FIG. 1 is a schematic view explaining, at a standby position, a compression molding machine which carries out the method of manufacturing according to a first embodiment of this invention.
Figure 2:
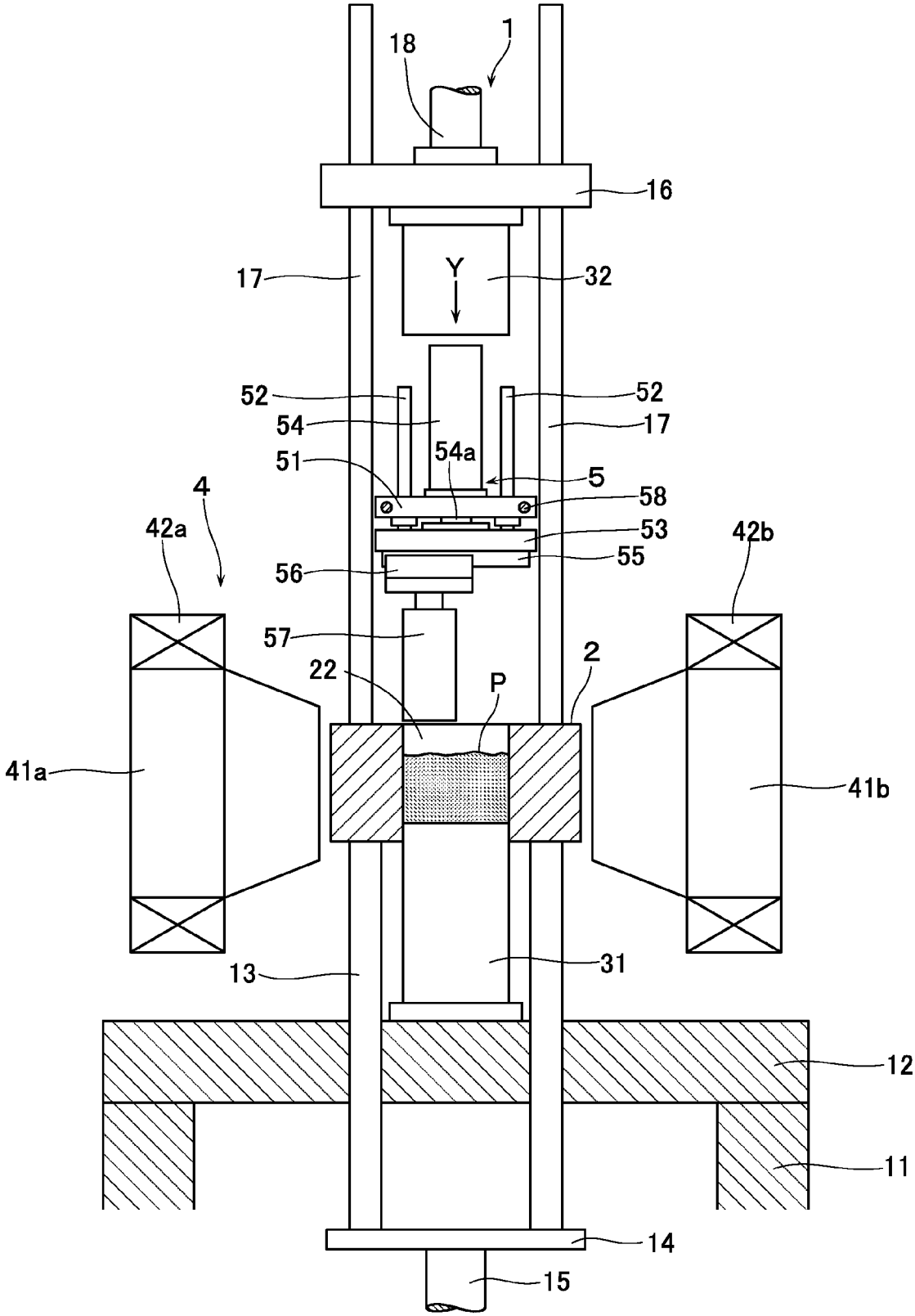
FIG. 2 is a schematic view explaining the compression molding machine shown in FIG. 1 in which the pressing means has been moved.
Figure 3:
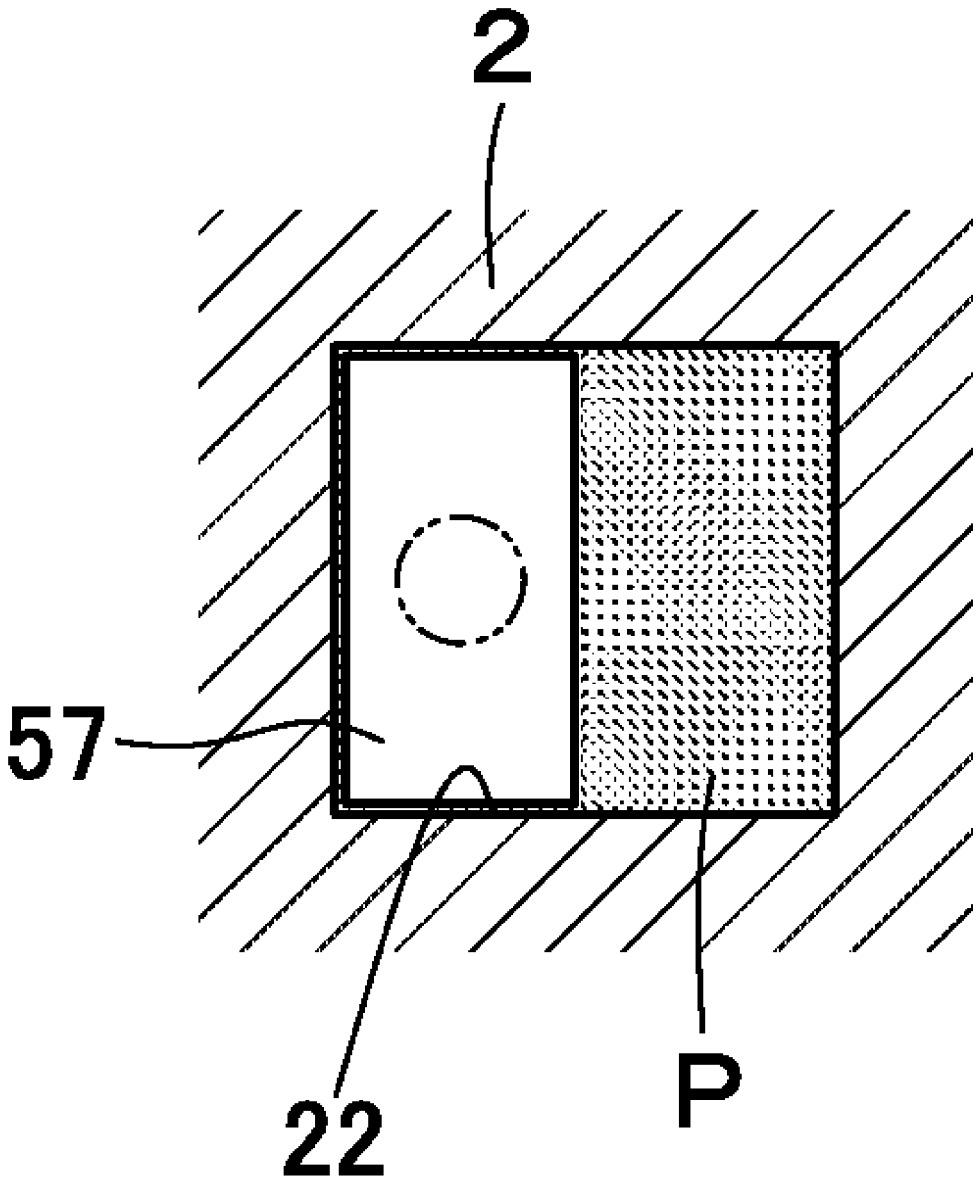
FIG. 3 is a schematic view explaining the position of the pressing means relative to the cavity.
Figure 4A:
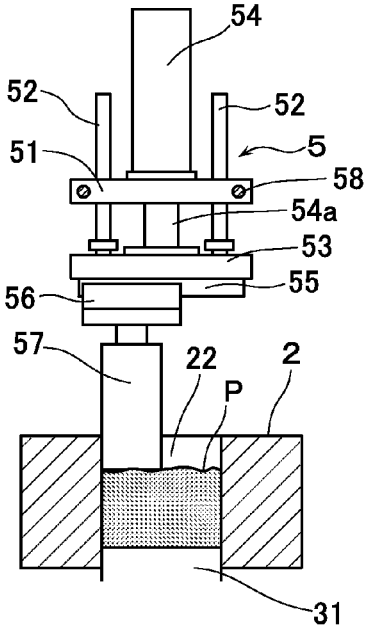
FIGS. 4(*a*) through 4(*f*) are schematic views explaining the operation of the pressing means (orienting step)
Figure 4B:
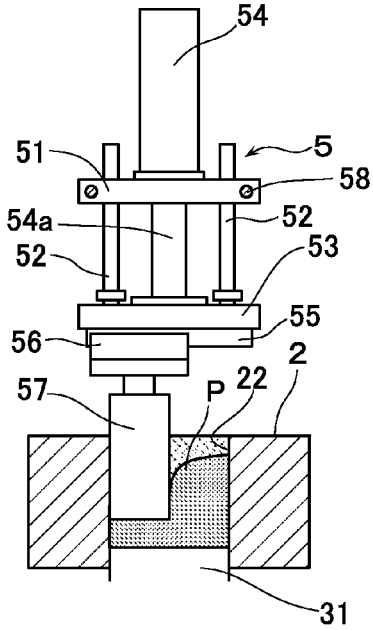
Figure 4C:
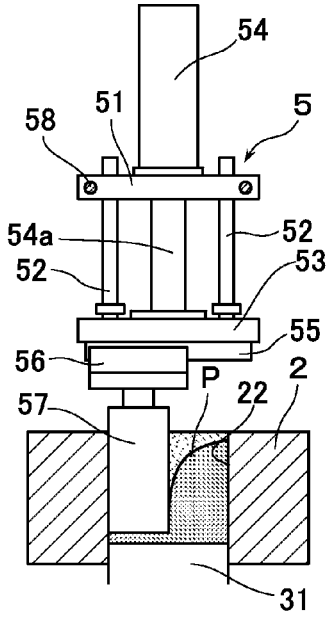
Figure 4D:
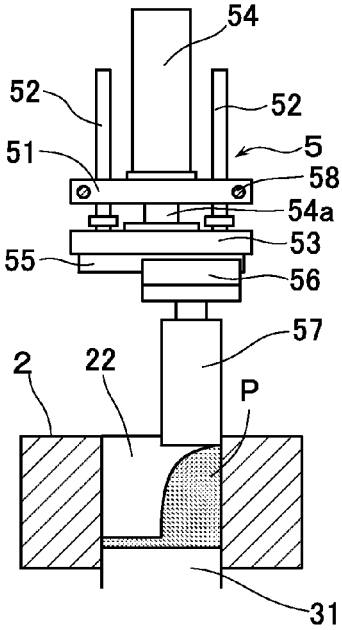
Figure 4E:
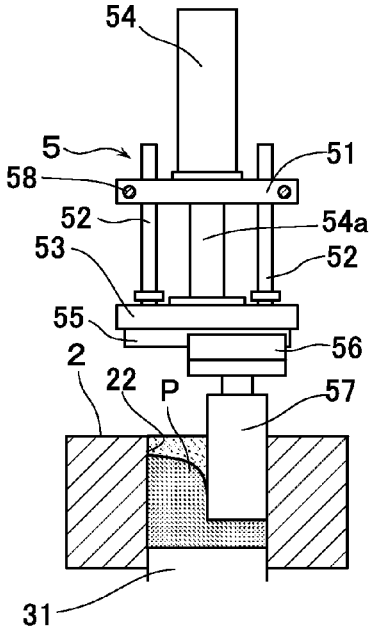
Figure 4F:
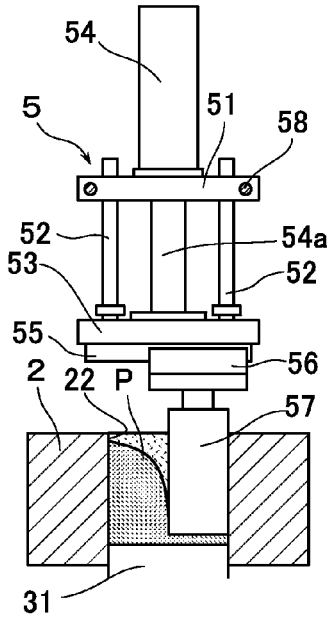
Figure 5A:
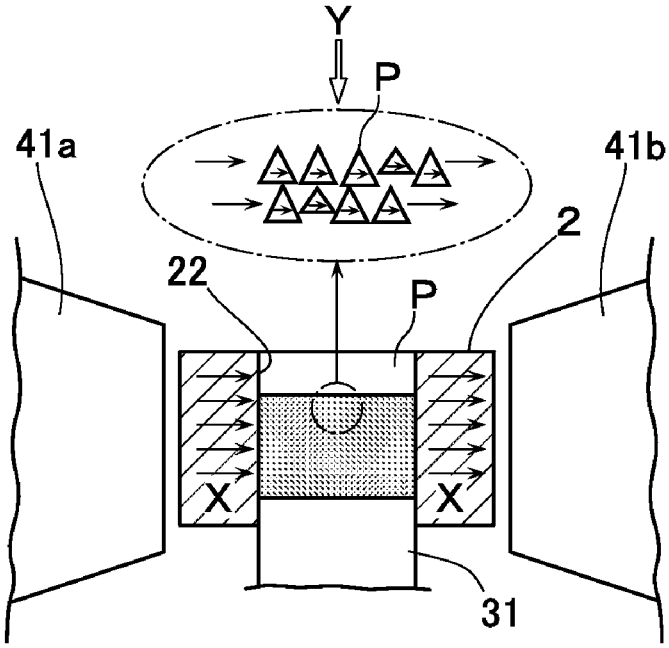
FIG. 5(*a*) is a schematic view explaining the magnetic orientation of the prior art, and FIG. 5(*b*) is a schematic view explaining the magnetic orientation according to the first embodiment of this invention.
Figure 5B:
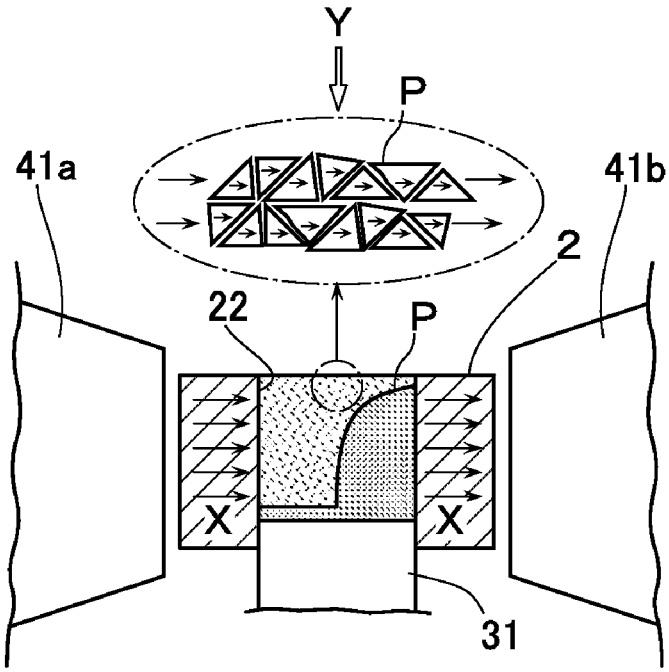
Figure 6:
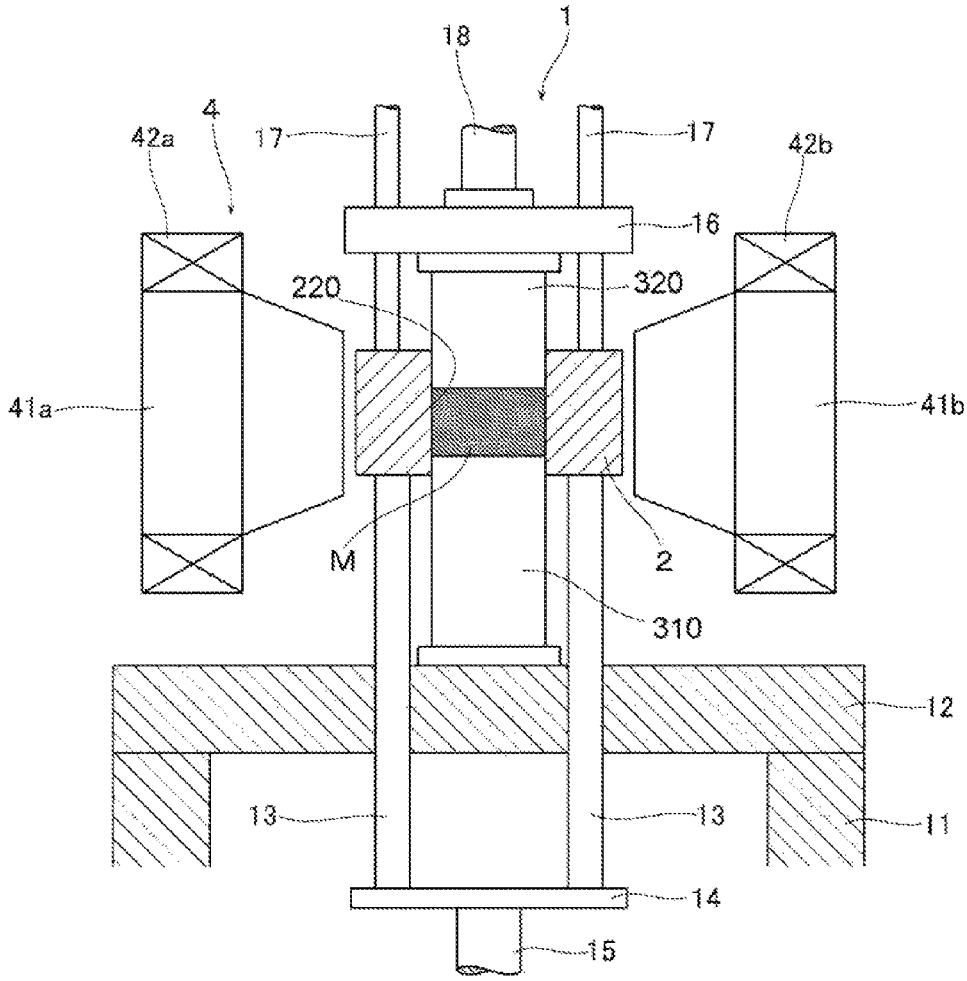
FIG. 6 is a schematic view explaining the molding step by the compression-molding machine shown in FIG. 1.
Figure 7:
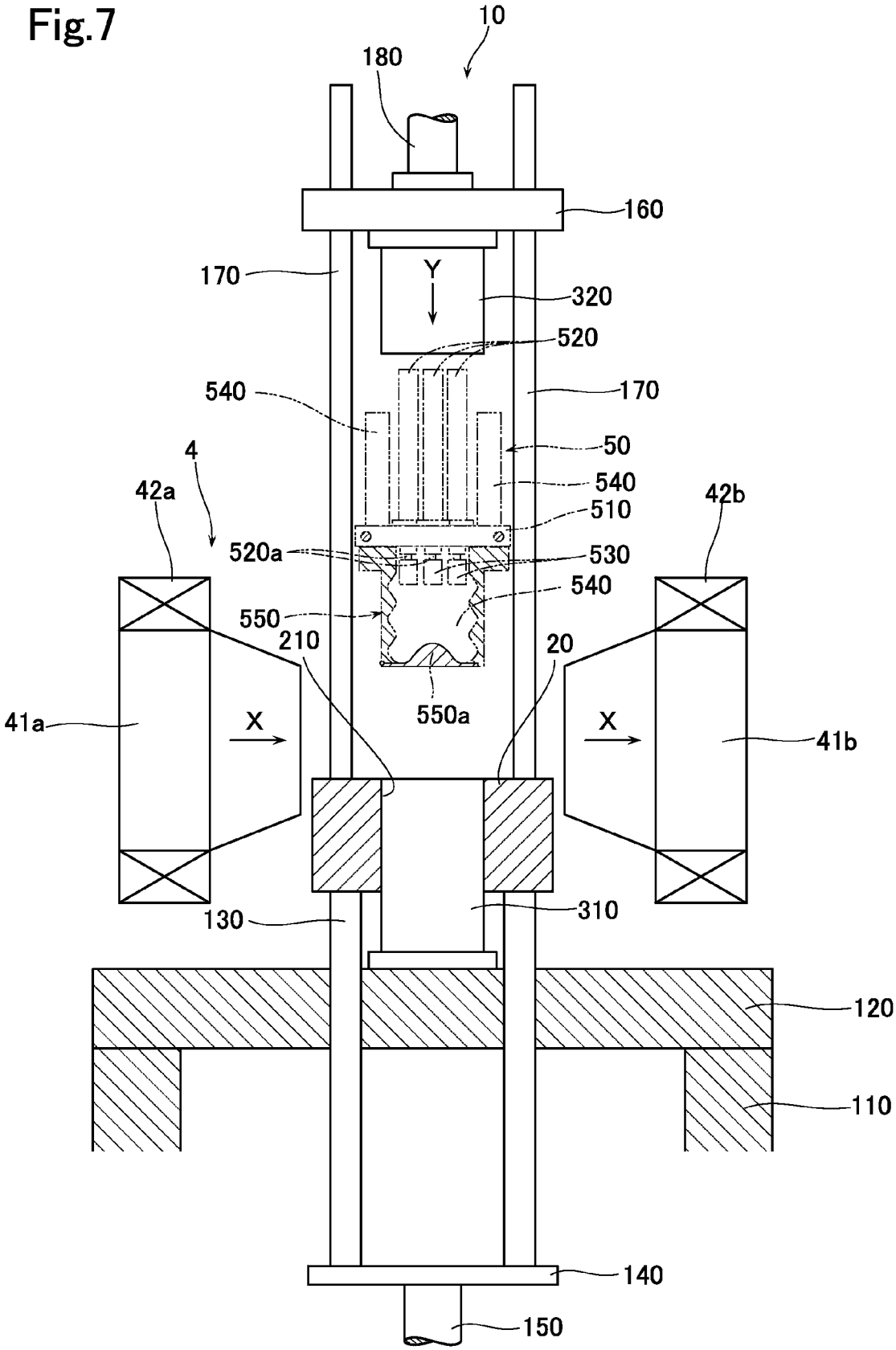
FIG. 7 is a schematic view explaining, at the standby position, a compression molding machine which carries out the method of manufacturing according to the second embodiment of this invention.
Figure 8:
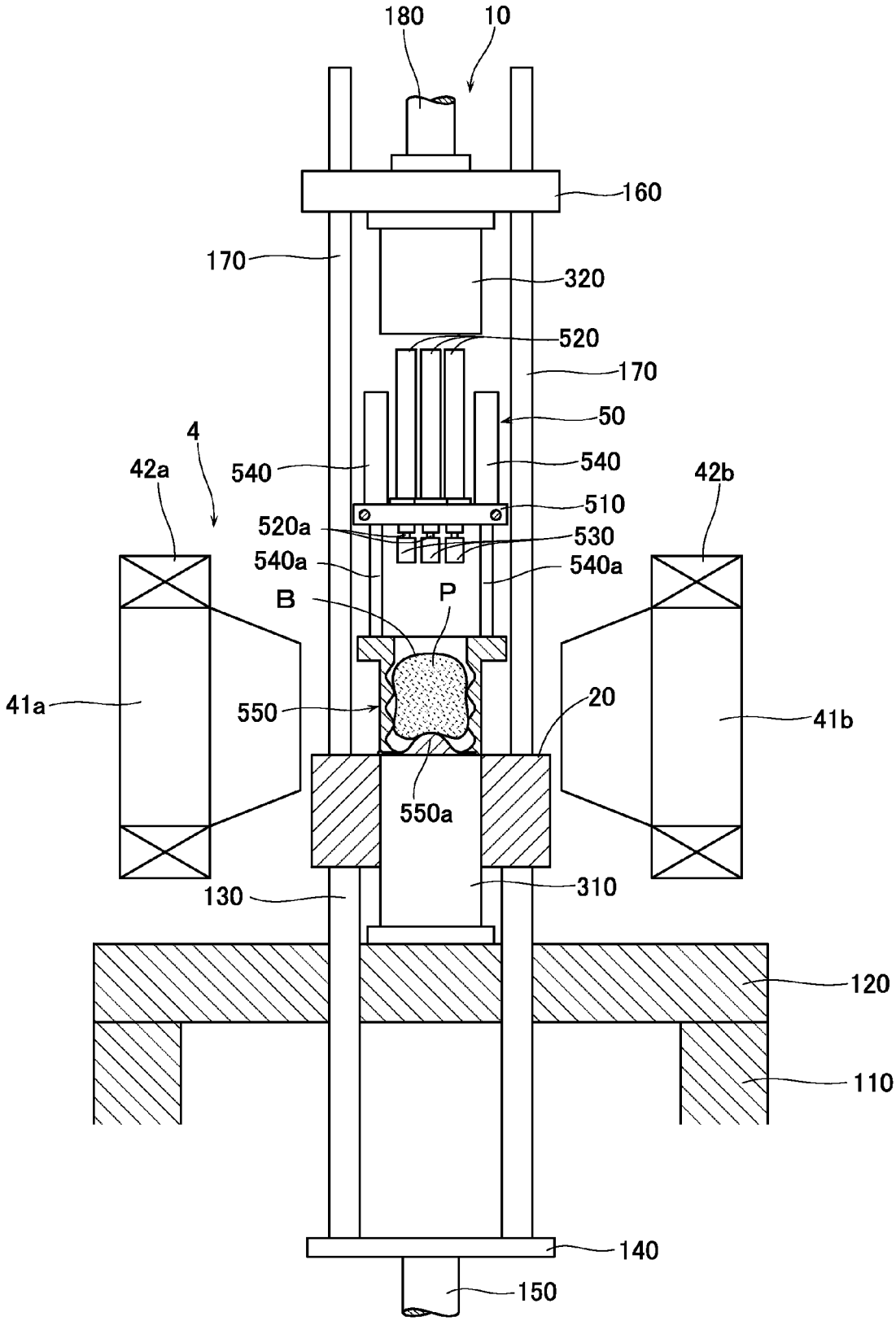
FIG. 8 is a schematic view explaining the compression molding machine, as shown in FIG. 7, in which the kneading means has been moved.
Figure 9:
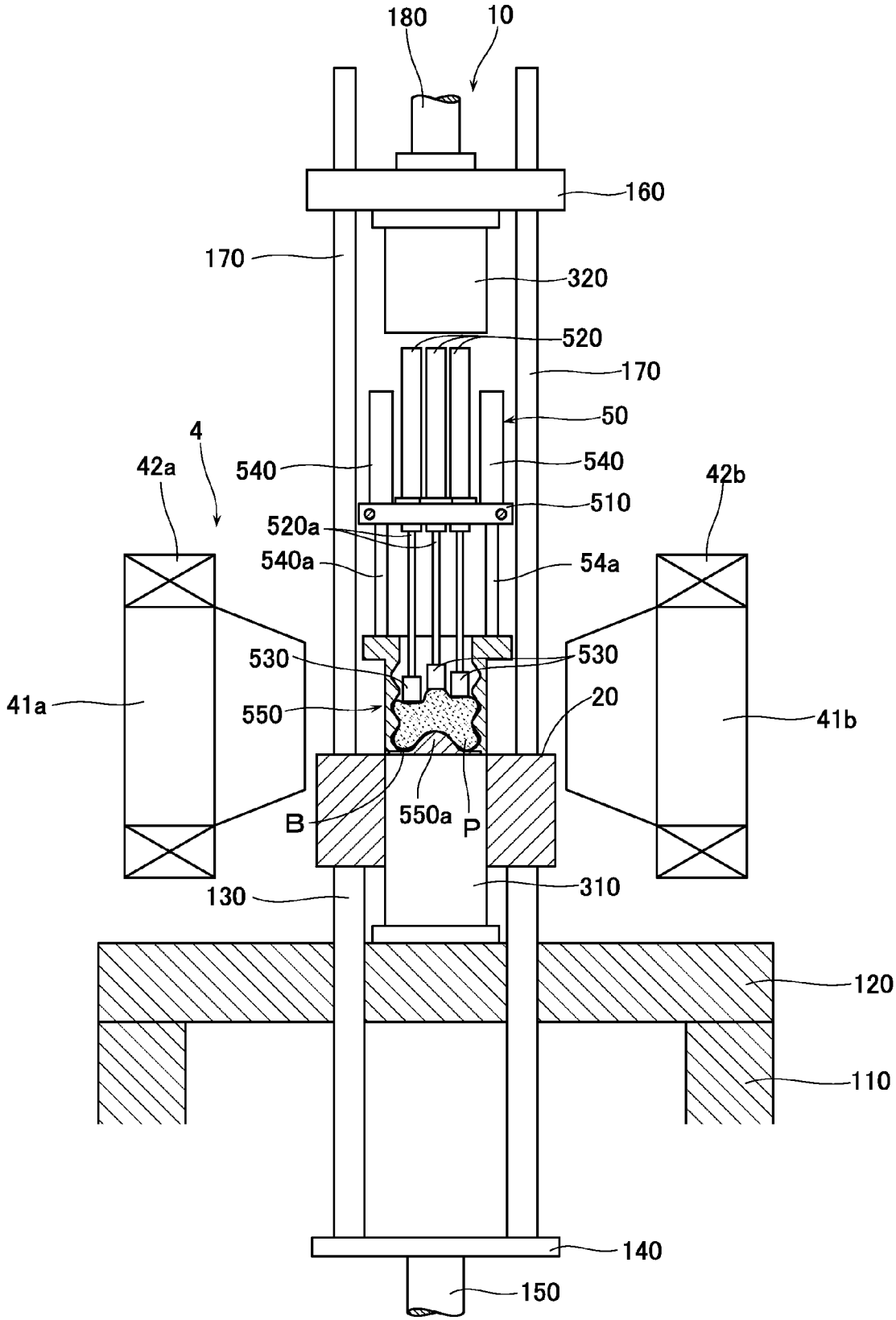
FIG. 9 is a schematic view explaining kneading, by kneading means, the raw metal powder inside a bag body.
Figure 10A:
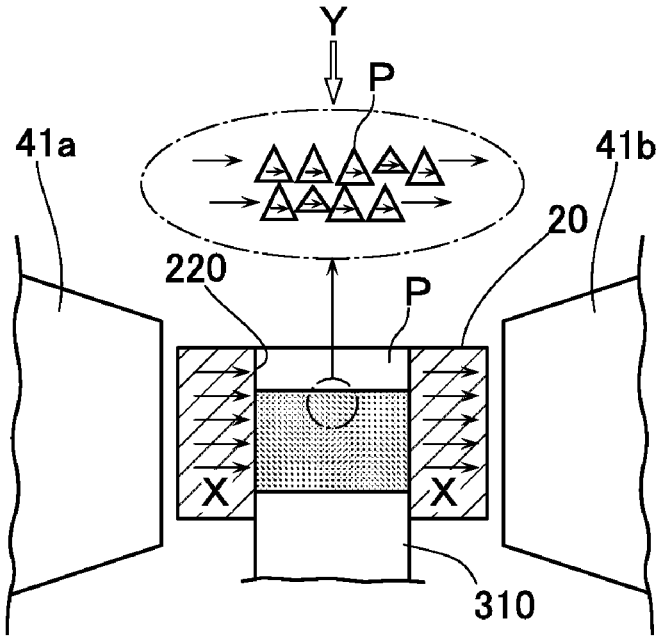
FIG. 10(*a*) is a schematic view explaining the magnetic orientation according to the conventional art, and FIG. 10(*b*) is a schematic view explaining the magnetic orientation by kneading according to the second embodiment of this invention.
Figure 10B:
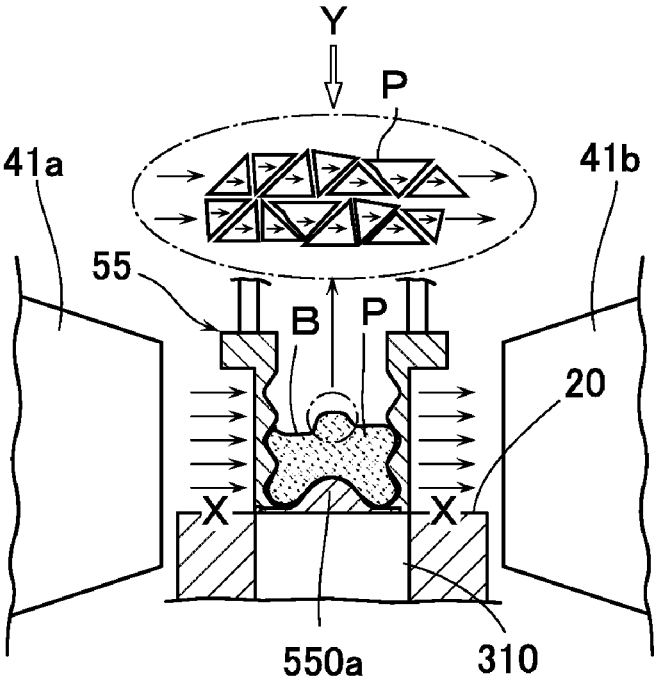
Figure 11:
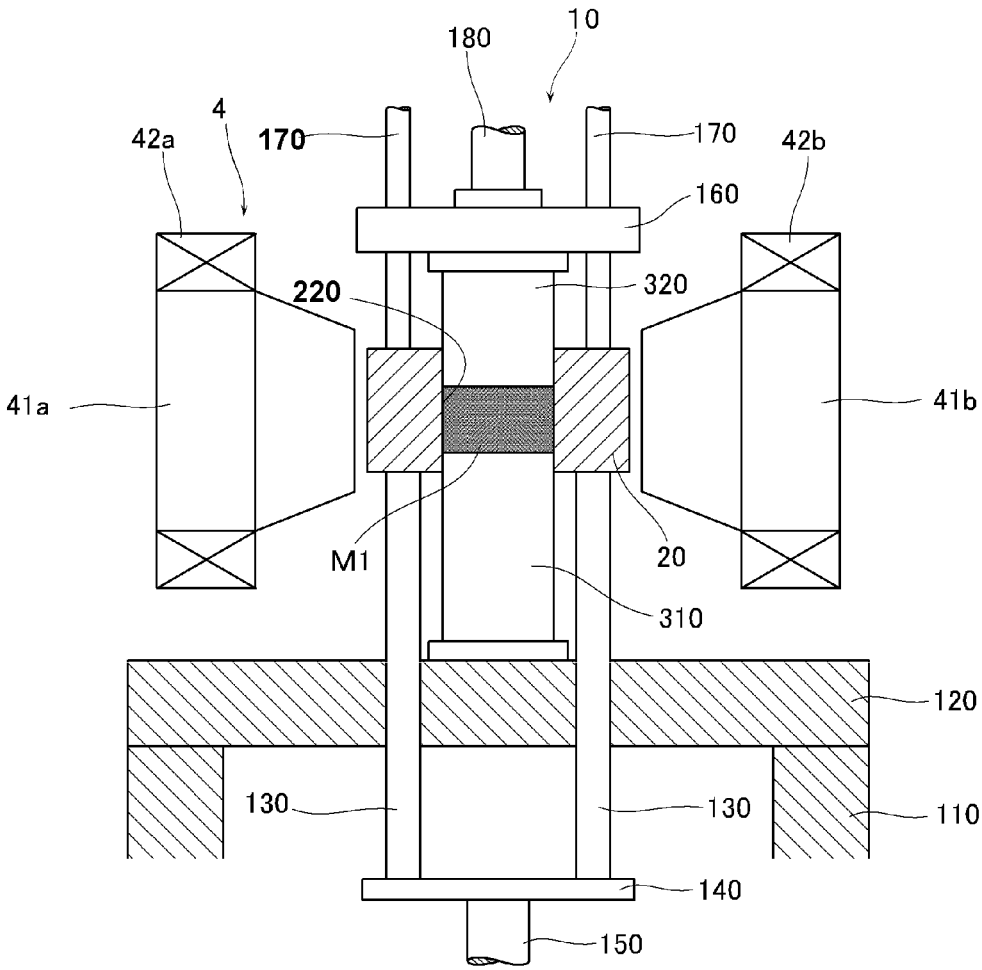
FIG. 11 is a schematic view explaining the molding step by the molding apparatus shown in FIG. 7.

1, 10 compression molding machine
2, 20 die
21, 210 through hole
12, 220 cavity
11, 32 punch
4 magnetic field generating apparatus
5 pressing means
57 pressing member
50 kneading means
530 pusher
p raw metal powder

What is claimed is:

1. A method of manufacturing a permanent magnet, the method comprising the steps of:

orienting raw metal powder filled into a filling chamber, the orienting being carried out in a magnetic field by subjecting the raw metal powder to pressing by pressing means having a smaller area than a cross-sectional area of the filling chamber; and molding under compression an oriented semi-finished product obtained by the orienting step, into a predetermined shape in the magnetic field, wherein a molding pressure is set to a range of 0.1~2.0 t/cm$^2$ and a strength of magnetic field is set to a range of 5 kOe~30 kOe.

2. The method of manufacturing a permanent magnet according to claim 1, further comprising changing the position of the pressing means sequentially so as to perform pressing by the pressing means over an entire cross-sectional area of the filling chamber.

3. The method of manufacturing a permanent magnet according to claim 1, further comprising vibrating the pressing means in the pressing direction at the time of pressing the pressing means.

4. The method of manufacturing a permanent magnet according to claim 1, further comprising adding to the raw metal powder a lubricant in a predetermined mixing ratio before filling the mixture into the filling chamber.

5. The method of manufacturing a permanent magnet according to claim 1, wherein the pressing means is made of a non-magnetic material.

6. A method of manufacturing a permanent magnet, the method comprising the steps of:

filling raw metal powder into a deformable bag body;

orienting the raw metal powder inside the bag body in a magnetic field by applying a localized pressing force to the bag body, while kneading the raw metal powder inside the bag body; and compression molding the oriented raw metal powder in the magnetic field into a predetermined shape, wherein a molding pressure is set to a range of 0.1~2.0 t/cm$^2$ and a strength of magnetic field is set to a range of 5 kOe~30 kOe.

7. The method of manufacturing a permanent magnet according to claim 6, further comprising mixing to the raw metal powder a lubricant in a predetermined mixing ratio before filling the mixture into the bag body.

8. The method of manufacturing a permanent magnet according to claim 1, further comprising a step of sintering a compression-molded semi-finished product obtained by the molding step.

9. The method of manufacturing a permanent magnet according to claim 1, further comprising:

manufacturing the raw metal powder by a quenching method, wherein the raw metal powder is for use with a rare-earth magnet.

10. The method of manufacturing a permanent magnet according to claim 6, further comprising a step of sintering a compression-molded semi-finished product obtained by the molding step.

11. A method of manufacturing a permanent magnet, the method comprising the steps of:

orienting raw metal powder filled into a filling chamber, the orienting being carried out in a magnetic field by subjecting the raw metal powder to pressing by pressing means having a smaller area than a cross-sectional area of the filling chamber; and sintering an oriented semi-finished product obtained by the orienting step, wherein a molding pressure is set to a range of 0.1~2.0 t/cm$^2$ and a strength of magnetic field is set to a range of 5 kOe~30 kOe.

12. A method of manufacturing a permanent magnet, the method comprising the steps of:

filling raw metal powder into a deformable bag body;

orienting the raw metal powder inside the bag body in a magnetic field by applying a localized pressing force to the bag body, while kneading the raw metal powder inside the bag body; and sintering an oriented semi-finished product obtained by the orienting step, wherein a molding pressure is set to a range of 0.1~2.0 $t/cm^2$ and a strength of magnetic field is set to a range of 5 kOe~30 kOe.

13. The method of manufacturing a permanent magnet according to claim 6, further comprising:

manufacturing the raw metal powder by a quenching method, wherein the raw metal powder is for use with a rare-earth magnet.

* * * * *